US005909604A

United States Patent [19]

Arai

[11] Patent Number: 5,909,604

[45] Date of Patent: Jun. 1, 1999

[54] IMAGE FORMING APPARATUS HAVING DEVELOPER COLLECTION CONTAINER

[75] Inventor: Hiroyuki Arai, Hachioji, Japan

[73] Assignee: Konica Corporation, Tokyo, Japan

[21] Appl. No.: 09/154,766

[22] Filed: Sep. 17, 1998

[30] Foreign Application Priority Data

Sep. 26, 1997 [JP] Japan ..... 9-261870

[51] Int. Cl.[6] ..... G03G 21/12

[52] U.S. Cl. ..... 399/35

[58] Field of Search ..... 399/24, 27, 34, 399/343, 360, 43, 35, 120, 358

[56] References Cited

U.S. PATENT DOCUMENTS 4,982,231 1/1991 Matsuuchi ..... 399/35

5,822,646 10/1998 Kinoshita et al. ..... 399/24

*Primary Examiner*—Sandra Brase
*Assistant Examiner*—Greg Moldafsky
*Attorney, Agent, or Firm*—Frishauf, Holtz, Goodman, Langer & Chick

[57] ABSTRACT

An image forming apparatus includes: a developer collection container for collecting a waste developer; a developer amount detector for detecting an amount of the waste developer in the developer collection container; a first cumulative print counter for counting a total number of prints produced during a period between a release of a filled state detection and a subsequent filled state detection, detected by the developer amount detector; and a judging device for judging whether or not the developer collection container is emptied according to the total number of prints counted by the first cumulative print counter.

6 Claims, 5 Drawing Sheets

IMAGE FORMING APPARATUS HAVING DEVELOPER COLLECTION CONTAINER

BACKGROUND OF THE INVENTION

The present invention relates to an image forming apparatus.

Conventionally, there has been an apparatus in which a developer amount detecting sensor is provided which detects the developer amount in a collection container which collects a waste developer in the development device section, etc. in an image forming apparatus, and upon detecting the developer amount in the above-mentioned collection container employing the above-mentioned sensor, when the collection container is nearly filled, a warning is given; and when the predetermined number of prints are produced after the warning, print production is prohibited.

However, in conventional apparatus, judgment is made in such a manner that in consideration of fluctuation in production of image forming apparatuses and in piles, etc. of the developer in the collection container (in a weight detecting apparatus, for example, fluctuation in humidity), the collection container has been filled before completely filled. Thereafter, by permitting print production until the predetermined number of prints so as to maximize the print production, apparatus troubles, etc. due to developer clogging, etc. in the conveyance path to the collection container when the collection container is filled, are prevented while maximizing the print production.

Accordingly, in the conventional apparatus, at detection of a filled collection container, for example, when the operator, etc. temporarily detaches the collection container, shakes the filled collection container, and remounts it without replacing the container with a new one, the apparatus is set at the initial state (the detection of a filled state is released) to permit the print production. Thus even though a filled container would be detected, there is the fear that the apparatus is in a state to permit the print production until the predetermined number of prints.

Namely, in such a case, the conventional apparatus, though it is filled, permits continued print production. Thus there has been a great concern that the apparatus is not properly operated due to developer clogging, etc. in the conveyance path to the collection container.

SUMMARY OF THE INVENTION

In view of the conventional situation mentioned above, the present invention is accomplished. An object of the present invention is to provide an image forming apparatus, with a simple and economical structure, which makes it possible to surely prevent apparatus troubles, etc. in case the operator, etc. remounts a collection container which is already filled.

An image forming apparatus includes: a developer collection container for collecting a waste developer; a developer amount detecting means for detecting an amount of the waste developer in the developer collection container; a first cumulative print counting means for counting a total number of prints produced during a period between a release of a filled state detection and a subsequent filled state detection, detected by the developer amount detecting means; and a judging means for judging whether or not the developer collection container is emptied according to the total number of prints counted by the first cumulative print counting means.

In such a structure, after the detection release of a filled developer collection container (after the replacement of the collection container, cleaning operation, etc.), the total number of prints, which are produced until the detection of the filled developer collection container, is counted, and based on the counted number of prints, judgment can be made on whether the developer collection container is properly emptied (replaced with a new one or properly cleaned) or not. Accordingly, even though a filled collection container is remounted, apparatus troubles, etc. due to developer clogging, etc. can be surely prevented.

DETAILED DESCRIPTION OF THE PREFERRED EMBODIMENT

One embodiment of the present invention is described with reference to the accompanied figuress below.

Figure 1:
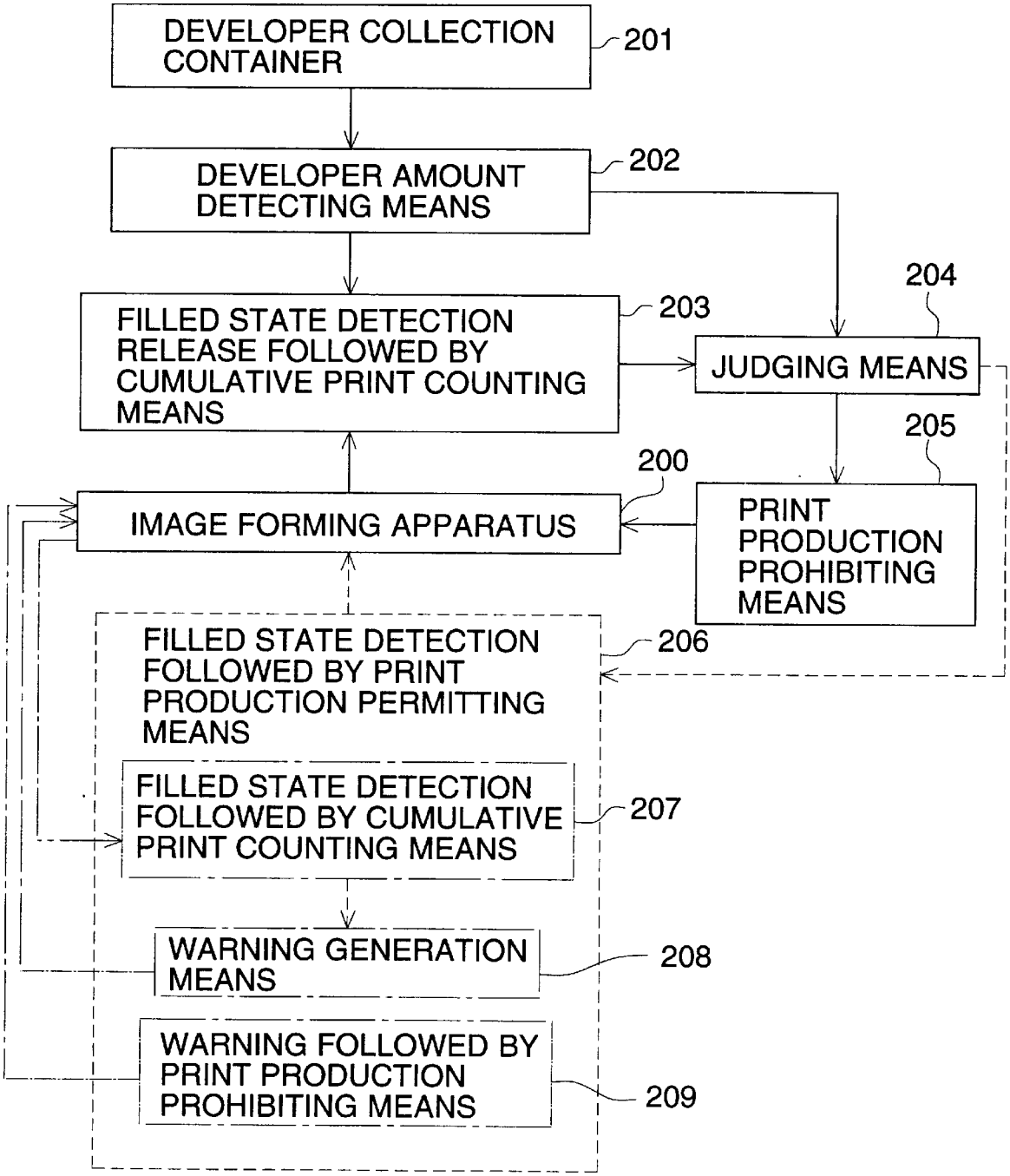
FIG. 1 is a flow of operations showing the structure and performance of the present invention.

A first structure of the present invention, as shown by the solid line in FIG. 1, in an image forming apparatus 200, which is constituted so as to include a developer collection container 201 which collects waste developer, is constituted to include a developer amount detecting means 202, which detects the developer amount in the above-mentioned developer collection container 201; a filled state detection release followed by cumulative print counting means 203, which counts the total number of prints produced during the period between the release of the filled state detection and the subsequent filled state detection employing the above-mentioned developer amount detecting means 202; a judging means 204 which judges whether the above-mentioned developer collection container is properly emptied or not, based on the total number of prints counted by the filled state detection release followed by cumulative print counting means 203; and a print production prohibiting means 205 which stops the subsequent print production until a predetermined reset operation is carried out, when the above-mentioned judging means determines that the above-mentioned developer collection container 201 is not properly emptied.

A second structure, in addition to the above-mentioned structure, as shown by a broken line in FIG. 1, is constituted so as to include a filled state detection followed by print production permitting means 206 therewith which permits the predetermined number of prints after filled state detection employing the above-mentioned developer amount detecting means 202. The structure is composed so that when the above-mentioned judging means 204 determines that the above-mentioned developer collection container 201 is properly emptied, print production for the predetermined number of prints is permitted after the detection of a filled state employing the above-mentioned filled state detection followed by print production permitting means 206.

In such a structure, a case when the above-mentioned developer collection container 201 is properly emptied and a case when the same container 201 is not properly emptied (when a filled collection container is remounted, etc.) are detectable. When judgment is made that the above-mentioned developer collection container is not properly emptied, after the detection of the filled state, print production is immediately stopped to prevent apparatus troubles, etc., so that when the above-mentioned developer collection container is properly emptied, in consideration of fluctuation in piles, etc. of the developer in the collection container, print production for the predetermined number of prints is permitted so that print production can be maximized. Accordingly, while maximizing the print production, apparatus troubles, etc. due to developer clogging, etc. can be prevented.

A third structure, as shown by the one-dot chain line in FIG. 1, is constituted so as to include the above-mentioned filled state detection followed by print production permitting means 206, the filled state detection followed by cumulative print counting means 207 for counting a total number of prints after detecting a filled state employing the above-mentioned developer amount detecting means 202, the warning generation means 208 which warns the approach of the total number of prints counted by the above-mentioned filled state detection followed by cumulative print counting means 207 to the initially predetermined number, while permitting print production, and a warning followed by print production prohibiting means 209 which prohibits subsequent print production until the predetermined resetting operation is carried out when the total counted number of prints reaches a second predetermined number which is larger than the first number.

In such a structure, operative effects similar to the second structure can be exhibited. In addition to those, when the total number of prints counted by the above-mentioned filled state detection followed by cumulative print counting means 207 reaches the first predetermined value, a warning is given, while permitting print production, and when the total number of prints counted by the above-mentioned filled state detection followed by cumulative print counting means 207 reaches the second predetermined value, the subsequent print production is prohibited. Accordingly, while forcing the operator, etc. to empty the developer collection container 201 (replacement, cleaning, etc.) following the warning, finally, print production can be stopped. Thus while maximizing print production, it can be expected that apparatus troubles, etc. due to developer clogging, etc. are more effectively prevented and surely avoided.

In a fourth structure, the above-mentioned predetermined resetting operation is composed of two actions, consisting of a detection release for the filled state employing the above-mentioned developer material amount detecting means 202 and the resetting performed by the operator.

In such a structure, the resetting conditions become severe. Thus when the collection container is not properly emptied (when the container is remounted), troublesome resetting operation will frequently be required. Accordingly, it is possible to more likely force the operator, etc. to properly empty the collection container. Furthermore, it can be expected that apparatus troubles etc. due to developer clogging, etc. are surely prevented.

Figure 2:
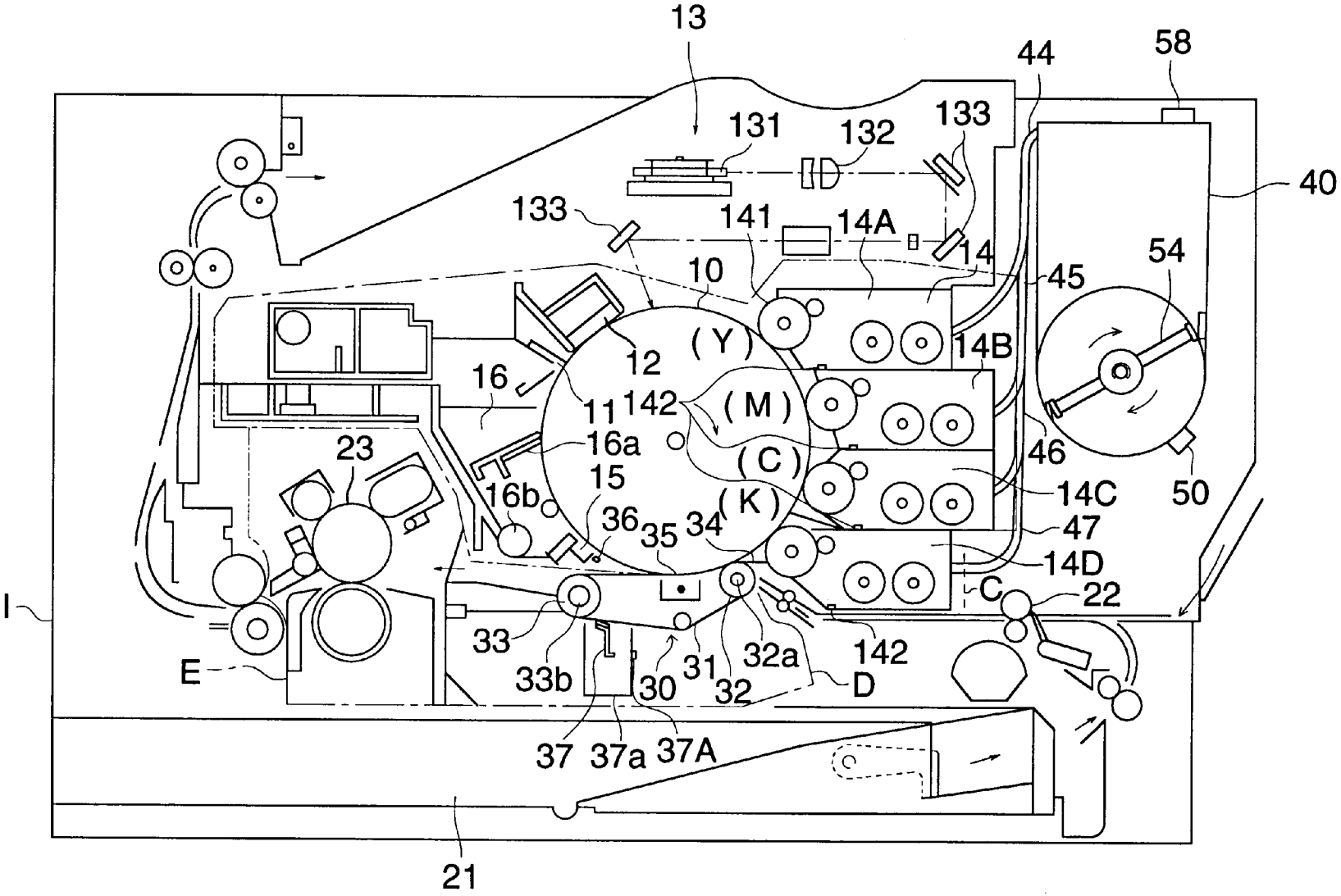
FIG. 2 is a longitudinal sectional view showing a general structure of a color laser printer associated with one embodiment of the present invention.

FIG. 2 shows a structure of a laser color printer as one embodiment of the image forming apparatus associated with the present invention.

The structure and performances are schematically described below. An OPC photosensitive layer-coated photoreceptor drum 10 provided in an apparatus body 1 is rotated in one direction (clockwise in FIG. 2), subjected to elimination of charge applied for the preceding print production, employing a charge eliminating device 11, and thereafter, the circumferential surface is uniformly charged by a charging device 12 and prepared for the subsequent print production.

After such uniform charging, image exposure is performed in accordance with image signals, employing an image exposure means 13. In the image exposure means 13, laser beams emitted from a laser source not shown are subjected to rotational scanning, employing a polygonal mirror 131; bent by reflection mirrors 133 after being passed through an fθ lens 132, etc.; projected onto the circumferential surface of the photoreceptor drum 10 previously charged to form a latent image on the surface thereof.

Around the circumference of the photoreceptor drum 10, are provided development devices 14A, 14B, 14C, and 14D, each of which is filled with a developer comprised of yellow (Y), magenta (M), cyan (C), black (K), etc. toners, respectively (coating materials) together with a carrier (magnetic material). First, a first color development is carried out employing a development sleeve 141 which houses a magnet in the interior and bears the developer.

The developer is regulated to form a layer having a predetermined thickness on the development sleeve 141 and conveyed to a development zone. AC bias $V_{AC}$ and DC bias $V_{DC}$ are superposed and applied to the gap between the photoreceptor drum 10 and the development sleeve 141. Here, $V_L$ represents an electrical potential of the exposed part of the photoreceptor drum 10 (grounded electrical potential) and $V_H$ represents the electrical potential of the surface other than the exposed part of the charged photosensitive layer. By setting the DC bias electrical potential $V_{DC}$ so as to hold $V_H>V_C>V_L$, a toner which is given a chance to detach from a carrier does not adhere to a part having higher potential $V_H$ than $V_{DC}$ and adheres to the exposed part having lower electrical potential $V_L$ than $V_{DC}$, and developed to form a visual image.

Further, development devices 14 are provided with a concentration sensor 142 which measures the toner concentration for each of the colored developers. In accordance with the measured toner concentration, respective toner is supplied into each specific development device 14 from a toner hopper, mentioned below, so as to allow approach of the toner concentration to the standard value. As toner concentration measurement methods, a method in which the variation in toner permeability is measured as the variation in inductance and the like, are known.

After the first color development is completed as mentioned above, a second color (for example, magenta) image forming process starts. The photoreceptor drum 10 is uniformly charged and a latent image in accordance with the second color image data is formed employing the image exposure means 13. As for a third color (cyan) and a fourth color (black), the same image forming processes as the second color are carried out and a total of four color images are developed on the circumferential surface of the photoreceptor drum 10.

On the other hand, a recording sheet fed by a sheet feeding mechanism 22 from a sheet feeding cassette 21 is transported to a nip portion (transfer zone) formed between the photoreceptor drum 10 and a transfer belt 31 employing a transfer belt device 30 in which the transfer belt 31 is entrained and the multiple color images on the circumferential surface of the photoreceptor drum 10 are simultaneously transferred onto the recording sheet.

Here, high voltage is applied to the shaft 32*a* of the holding roller 32 of the upper flow side of the transfer belt 31, and an electrically conductive brush 34 disposed in the position facing this shaft 32*a* crossing the transfer belt 31 is grounded and the transported recording sheet enters a space between the brush 34 and the transfer belt 31, and further enters a transfer zone, while being attracted by the transfer belt 31 by the charge injected to the recording sheet employing the brush 34.

The recording sheet separated from the photoreceptor drum 10 is separated from the transfer belt while being subjected to charge elimination employing the shaft 33*b* of the bearing roller 33 on the downstream side entraining about the transfer belt as an counter electrode. The toner adhered on the transfer belt 31 is removed employing a cleaning blade 37 and collected in a collection container 37*a*. Further, during forming multicolor images, the transfer belt 31 is kept away from the photoreceptor drum 10 employing the shaft 33*b* of the bearing roller 33 in the downstream side as a rotation center.

The recording sheet separated from a transfer belt device 30 is conveyed to a fixing device 23 composed of a pair of pressure contact rollers in which at least one of the rollers comprises a heater in the interior, and subjected to application of heat and pressure between the two pressure contact rollers to melt and fix the adhered toner on the recording sheet and then ejected to the exterior of the apparatus.

Any residual toner on the circumferential surface of the photoreceptor drum 10 after transfer is subjected to charge elimination employing a charge eliminating device 15, and thereafter, conveyed to a cleaning device 16, scraped down into the cleaning device employing a cleaning blade 16*a* which physically contacts the photoreceptor drum 10, and removed employing a screw 16*b*, etc. and then stored in a recovery container 37*a*.

The photoreceptor drum 10 which has been subjected to removal of any residual toner is subjected to exposure employing the charge eliminating device 11; thereafter, is subjected to uniform charging employing the charging device 12, and then enters the subsequent image forming cycle. Furthermore, when the recording sheet is not separated from the above-mentioned transfer belt 31 and conveyed to a more advanced position than the charge eliminating device 15 while being wound round on the photoreceptor drum 10, the above-mentioned cleaning blade 16 and electrode wire may be damaged. Accordingly, a jam sensor 36 which detects winding-round of the recording sheet is mounted near the above-mentioned charge eliminating device 15.

Figure 3:
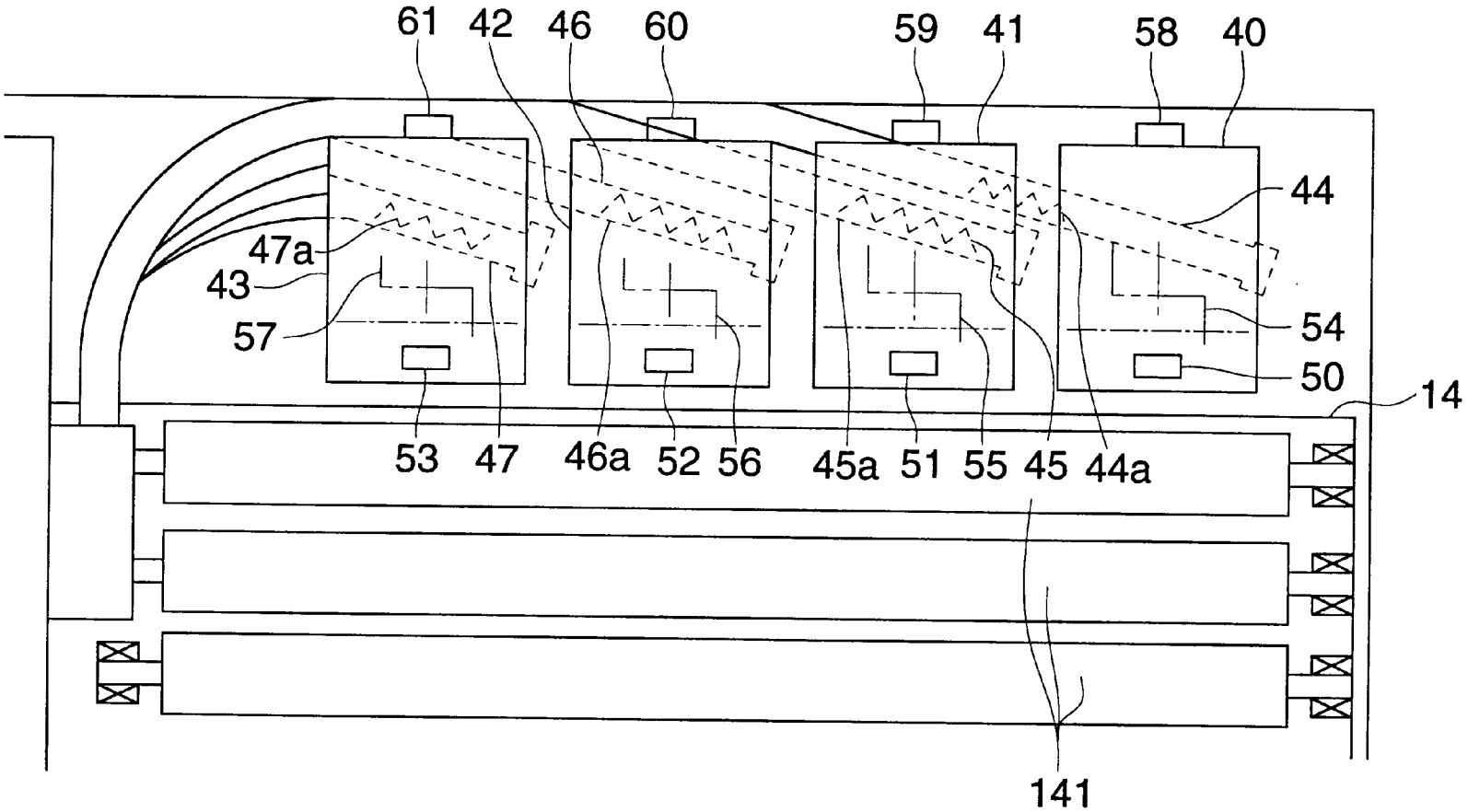
FIG. 3 is a traverse sectional view showing one part of the above printer.

Furthermore, as shown in FIG. 3, in order to supply, to each of development devices 14A through 14D, each of yellow (Y), magenta (M), cyan (C), and black (K) toners, there are provided toner hoppers 40 through 43, which fill up each of color toners, and conveyance pipes 44 through 47 which convey the toner in each of these hoppers 40 through 43 to each of development devices 14A through 14D, employing the rotational drive of built-in screws 44*a* through 47*a* by a development device driving motor not shown. Under an ordinary print mode, the toner concentration of each of the development devices 14A through 14D is measured, and when toner concentration in the development device decreases, the toner of which concentration decrease is detected is supplied to the development device from the hopper filled with the toner through the conveyance pipe by drive-rotating the conveyance screw in the conveyance pipe so as to control the toner concentration suitable for development.

Further, in each of the hoppers 40 through 43, there are mounted residual amount sensors 50 through 53 as residual developer amount detecting sensors, which detect the residual amount (existing amount) of a toner (developer) in the hopper, and along with these, for example, paddles 54 through 57 which are rotationally driven in the hopper while being linked with a conveyance screw, etc. upon supplying the toner to the above-mentioned development device so that the toner is not solidified. Furthermore, in order to prevent the excessive supply of the toner to the upper part of the hopper, there are mounted excessive supply preventing solenoids 58 through 61 which open or close a toner supply aperture.

The above-mentioned residual amount sensors 50 through 53 are composed of, for example, a piezoelectric element, etc. When toner is filled higher than the mounted position of residual amount sensors 50 through 53, signal "H" denoting the presence of a toner is outputted. When the toner height becomes lower than the mounted position, signal "L" denoting the lack (shortage) of toner is outputted.

Figure 4:
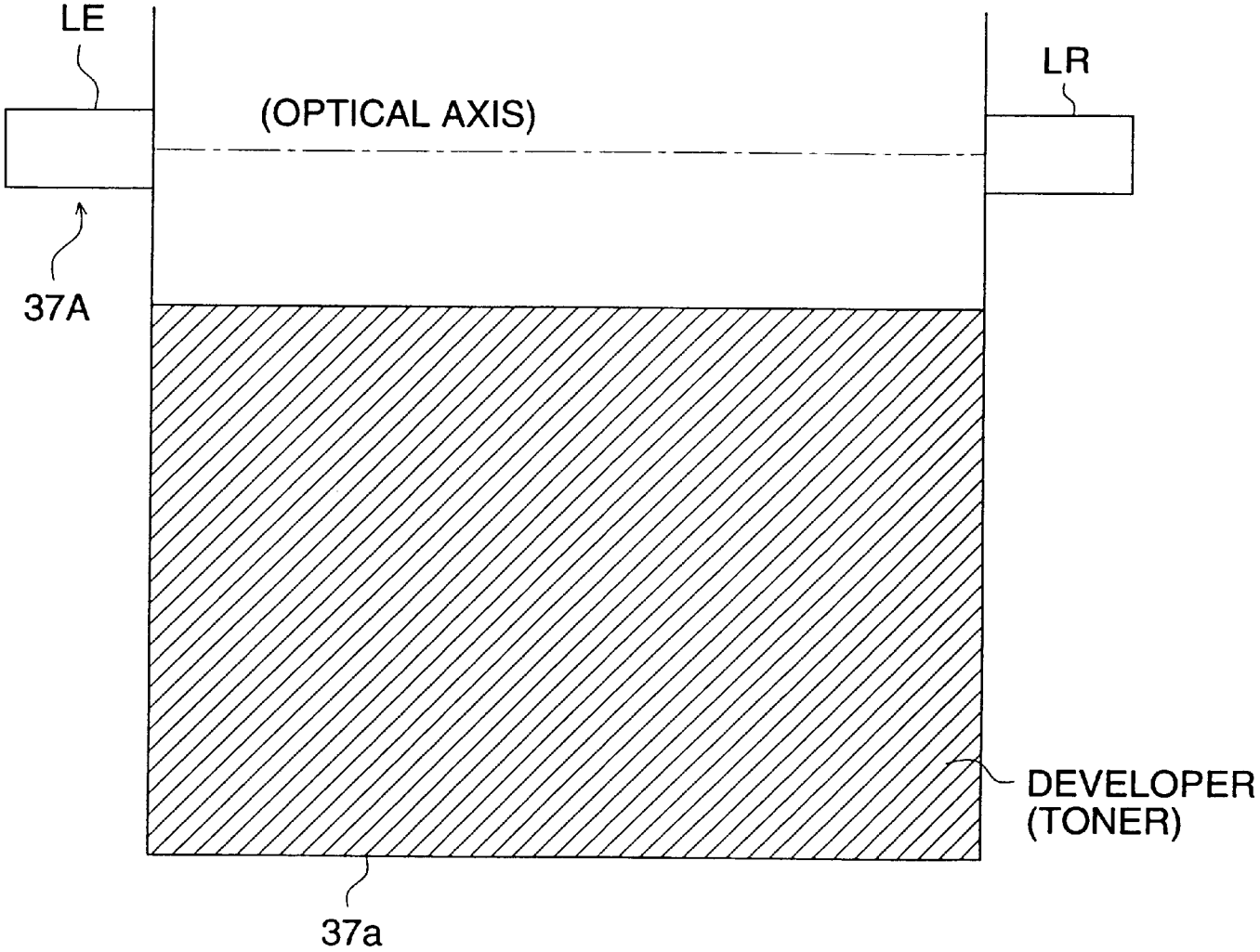
FIG. 4 is a view showing one example of a developer amount detecting sensor in which a light-emitting element and a light-receiving element are employed.

Provided in the present embodiment, as shown in FIG. 4, in the above-mentioned collection container 37*a*, is the developer amount detecting sensor 37A which measures the residual developer amount in the collection container 37*a*. The developer amount detecting sensor 37A is equivalent to the developer amount detecting means according to the present invention.

In FIG. 4, the developer amount detecting sensor 37A is described as a type of unit which is provided with the light sensor composed of a light-emitting element LE and a light-receiving element LR, and detects the present developer amount based on a light receiving amount, etc. at the light-receiving element LR for the light emitted by the light-emitting element LE. However, various other types may also be employed in which, for example, a developer amount is detected employing a microswitch; the same is electrically detected employing the dielectric constant of a developer; the same is detected based on vibration properties of a piezoelectric element which vary in accordance with a contacting developer amount.

Figure 5:
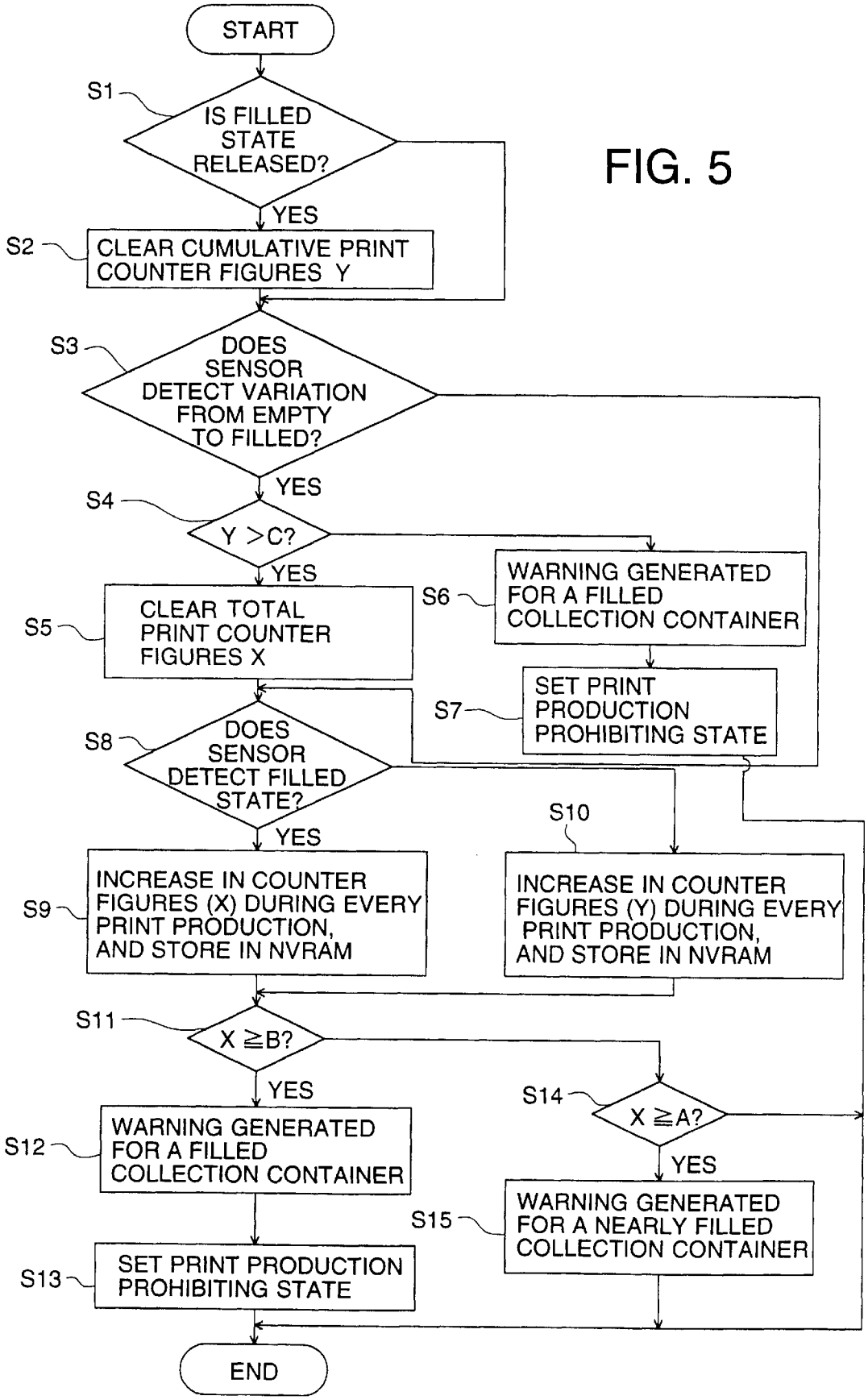
FIG. 5 is a flow chart describing various operations which are performed, when it is detected that developer is piled in the above embodiment.

The operation which is carried out at the detection of developer container filled state in the present embodiment is herein described in accordance with the flow chart in FIG. 5.

A control section (not shown in FIG. 5) composed of CPU, various ROMS, RAMs, etc. performs operations in the flow chart shown in FIG. 5. By employing these, the control section is provided, with software, which performs functions such as the above mentioned first cumulative print counting means 203, judging means 204, print production prohibiting means 205, print production permitting means 206, second cumulative print counting means 207, warning generation means 208, and print production prohibiting means 209.

Namely:

in Step 1 (in FIG. 5, abbreviated as S1, and the same abbreviations are applied below), judgment is performed on whether a filled detection state employing the developer amount detecting sensor 37A is released or not upon replacing the collection container 37*a* to a new one or cleaning by the operator, etc., that is, judgment is made on the first routine after the release of the filled state detection.

When YES is the result, Step 2 is taken. When NO is the result, Step 2 is skipped and Step 3 is taken.

In Step 2, because the first routine is performed after the replacement of the collection container 37*a*, the cumulative print count (Y) after the release of the filled detection state is cleared (reset to 0) and Step 3 is taken.

In Step 3, judgment is made as to whether a developer amount detecting sensor 37A detects whether the collection container has changed from empty to filled.

When YES is the result, Step 4 is taken. When NO is the result (when the collection container is empty, or a filled state is continuously detected), Step 8 is taken.

In Step 4, comparison is made (judgment is made on whether Y>C is held or not) between the cumulative print counter figures (Y) after the release of the filled detection state and a predetermined value C (a threshold value to judge whether the collection container 37*a* is practically replaced or not (whether the filled collection container is remounted or not)).

When YES (Y>C) is the result, because judgment can be made that the collection container 37*a* is properly replaced with a new one (the filled collection container is not remounted, etc.), Step 5 is taken.

On the other hand, when NO (Y≦C) is the result, after the release of the filled state detection, that is, after the replacement of the collection container 37*a*, the collection container 37*a* is filled earlier than estimated. Therefore, because judgment can be made that the collection container 37*a* is not properly replaced with a new one (a filled collection container was remounted, etc.), Step 6 is taken.

In Step 6, because the collection container 37*a* is not practically replaced with a new one (the filled collection container is remounted, etc.), the apparatus troubles etc. may be liable to be caused. Thus after warning that the collection container 37*a* is filled, Step 7 is taken to set the image forming apparatus 1 at print operation prohibiting state and the present flow is terminated.

In contrast to this, in Step 5, because judgment can be made that the collection container 37*a* is replaced with a new one, the total print counter figures (X) in the filled state detection followed by print production permitting state, which permits the print production of the predetermined number of prints after detecting the filled state is cleared or reset to zero and Step 8 is taken.

In Step 8, judgment is made on whether the developer amount detecting sensor 37A detects the filled state of the collection container 37*a* or not.

When YES is the result, Step 9 is taken to increase the total print counter figures (X) in the filled state detection followed by print production permitting state, which permits the production of the predetermined number of prints after detecting the filled state.

When NO is the result, because a judgment can be made that the collection container 37*a* is in an empty state, Step 10 is taken to increase the cumulative print counter figures (Y) after the release of the filled detection state.

In Step 10, in each print production, the cumulative print counter figures (Y) is increased, and after storing the figures in NVRAM (non-volatile random access memory device: non-volatile RAM), Step 11 and the consecutive steps are taken, and substantially, the present flow is terminated. Further, a return to Step 3 may be employed.

Namely, from the release of the filled state to the detection in which an empty collection container 37*a* is completely filled, the cumulative print counter figures (Y) is increased to judge that the collection container 37*a* is properly replaced with a new one.

Further, when the empty collection container 37*a* is filled, or when the filled state is continued, Step 9 is taken. Therefore, at each print production, the total print counter figures (X) is increased which is in the filled state detection followed by print production permitting state, which permits the production of the predetermined number of prints after detecting the filled state, and after storing the figures in NVRAM, Step 11 is taken.

In Step 11, a comparison (X≧B) is made between the total print counter figures (X) in the filled state detection followed by print production permitting state and a predetermined value B (a threshold value to judge whether in such a state that the collection container 37*a* is filled, the prohibition of print production is required or not; equivalent to the second predetermined value).

When YES (X≧B) is the result, it is immediately required to prevent apparatus troubles etc. by prohibiting the print production. Thus in Step 12, after warning that the collection container 37*a* is filled, Step 13 is taken; the image forming apparatus 1 is set in a print production prohibiting state, and the present flow is terminated.

On the other hand, when NO (X<B) is the result, Step 14 is taken.

In Step 14, a comparison (X≧A; B>A) is made between the total print counter figures (X) in a filled state detection follows by print production permitting state and a predetermined value A (a threshold value to judge whether in such a state that the collection container 37*a* is nearly filled, warning is required or not; equivalent to the first predetermined value).

When YES is the result, Step 15 is taken. After the warning that the collection container 37 is nearly filled, the present flow is temporarily terminated to repeat the above-mentioned flow, until a YES judgment indicats in Step 11.

When NO is the result, as being considered that the developer amount detecting sensor 37A detected the filled state of the collection container 37*a* a relatively short time ago (some room left for more print production), the present flow is temporarily terminated to repeat the above-mentioned flow until a YES judgment results in Step 11 or 14.

As mentioned above, in the present embodiment, the cumulative prints which are produced between the release of the filled detection state (after the replacement of the collection container 37*a*, etc. is carried out) and the detection that the empty collection container 37*a* is filled again can be detected via the above-mentioned cumulative print counter figures (Y). Based on this, it becomes possible to judge whether the collection container 37*a* is actually replaced or not.

Furthermore, in the present embodiment, when judgment is made that the filled detection state is released but the collection container 37*a* is not properly replaced with a new one (a filled collection container is remounted, and the collection container is not properly emptied), at the time, print production is stopped. Thus apparatus troubles etc. due to developer clogging, etc. can be prevented.

Namely, when considering fluctuation of the piles, etc. of the developer in a collection container, after detecting a filled state, an operation which permits the production of the predetermined number of prints is carried out so as to maximize the print production, the conventional apparatuses may cause troubles, etc. due to developer clogging, etc., in the following manner. Even when a filled state is detected after the filled collection container is remounted, etc., the above-mentioned operation is carried out and production of the predetermined number of prints is permitted. However, in the present embodiment, when a filled state is detected after remounting a filled collection container, the above-mentioned operation is immediately stopped without carrying out the above-mentioned operation. Thus, conventional apparatus troubles, etc. due to developer clogging, etc. are surely avoided.

Furthermore, in the present embodiment, when a judgment is made that the collection container 37*a* is properly replaced with a new one (the collection container is properly emptied) and later than that, the filled state is detected, in the same manner as above, considering fluctuation of piled shapes, etc. of the developer in the collection container, after detecting a filled state, operation can be permitted so as to maximize the print production.

Eventually, by employing the present embodiment, print production can be maximized while surely preventing apparatus troubles, etc. due to developer clogging, etc. in the conveyance path to the collection container for such cases not only when after detecting a filled state, the operator, etc. detach the collection container and replace it with a new collection container (the collection container is properly emptied), but also when after detecting a filled state, the operator, etc. detach the collection container but remount it after shaking it (the collection container was not properly emptied).

Further, in the above-mentioned flow, a prohibition state resetting in the case of prohibiting print production (when passing Step 7 or Step 13) may be subjected to conditions such as release of a filled state detection. However, in order to force the operator, etc. to properly carry out the replacement of the collection container, it is preferred to make the resetting condition severer so that resetting operation becomes troublesome which frequently occurs for such a case in carrying out remounting. For example, it is preferred that conditions are such as two actions of the above-mentioned release of the filled state detection and resetting by the operator, etc.

The above-mentioned resetting operation performed by an operator, etc. as described herein denotes that, for example, an operator, etc. manipulates a reset switch, or a pass word written on, for example, a bag or a box of a replacement part (fresh collection container) or on a collection container body is inputted to a controlling section, etc. (including inputting from a personal computer).

Further, in the above-mentioned embodiment, description is made with reference to the case in which the collection container 37*a* is replaced at the detection of a filled state. However, the present invention is not limited to the above example, and may be applied to cases when the collection container 37*a* is emptied by cleaning at the detection of a filled state.

Furthermore, the present invention can be applied to cases in which the collection container 37*a* is integrally formed with the photoreceptor drum 10, etc. (when the collection container 37*a* is one constituting element of a so-called drum cartridge or transfer unit; in other words, neither replacement nor cleaning is allowed for a unit form as a collection container), and the filled state detection unit of the collection container also detects the life (replacement time) of the above-mentioned drum cartridge and transfer unit. In such cases, the present invention can surely prevent apparatus troubles, etc. due to the use of the above-mentioned drum cartridge and transfer unit beyond the life time, because as compared to the conventional apparatus, print production beyond the span of life of the above-mentioned drum cartridge and transfer unit can be more surely prohibited and the replacement of the above-mentioned drum cartridge and transfer unit is more surely enforced.

Namely, when the collection container is one constituting element among those termed a so-called drum cartridge, transfer unit, etc., and the detection of the filled state of the collection container is also used for the detection of the life span (detection of the replacement time) of the above-mentioned drum cartridge and transfer unit, in terms of no damage given to the apparatus, the effect of the present invention is much more exhibited.

As described above, after the detection release of the filled state of a developer collection container (after performing the replacement of the collection container, or cleaning work), the total number of prints produced until the detection of the subsequent filled state of the developer collection container are counted and it makes it possible to judge, based on the total number of prints, whether the developer collection container is properly emptied (replaced with a new one, or properly cleaned) or not. Accordingly, even in the case in which the filled collection container is remounted, apparatus troubles, etc. due to developer clogging, etc. are surely prevented.

According to the invention, while maximizing the print production, apparatus troubles, etc. due to developer clogging, etc. can also be surely prevented.

According to the invention, because it is possible to force the operator to properly empty the collection container, etc., it can be expected that apparatus troubles, etc. due to developer clogging, etc. are more surely prevented.

What is claimed is:

1. An image forming apparatus comprising:

(a) a developer collection container for collecting a waste developer;

(b) developer amount detecting means for detecting an amount of the waste developer in the developer collection container;

(c) cumulative print counting means for counting a total number of prints produced during a period between a release of a filled state detection and a subsequent filled state detection, detected by said developer amount detecting means; and (d) judging means for judging whether or not said developer collection container is emptied according to the total number of prints counted by said cumulative print counting means.

2. The image forming apparatus of claim 1 further comprising print production prohibiting means for stopping subsequent print production until a predetermined reset operation is carried out, when said judging means judges that said developer collection container is not emptied.

3. The image forming apparatus of claim 2, wherein said predetermined reset operation includes conditions that a detection of filled state by said developer amount detecting means is released and that an operator manipulates a reset switch or inputs a password written on a bag of a replacement developer collection container to a control section of said apparatus.

4. The image forming apparatus of claim 1 further comprising print production permitting means for permitting a predetermined number of prints after a filled state is detected by said developer amount detecting means, wherein when said judging means judges that said developer collection container is emptied, said print production permitting means permits a print production for the predetermined number of prints.

5. The image forming apparatus of claim 4, wherein said print production permitting means comprises:

second cumulative print counting means for counting a second total number of prints after said developer amount detecting means detects a filled state; and warning generation means for warning that the second total number of prints counted by said second cumulative print counting means reaches a predetermined value, while permitting print production.

6. The image forming apparatus of claim 1 further comprising:

print production permitting means for permitting a predetermined number of prints after a filled state is detected by said developer amount detecting means, wherein when said judging means judges that said developer collection container is emptied, said print production permitting means permits a print production for the predetermined number of prints;

second cumulative print counting means for counting a second total number of prints after said developer amount detecting means detects a filled state;

warning generation means for warning that the second total number of prints counted by said second cumulative print counting means reaches a first predetermined value, while permitting print production; and print production prohibiting means for prohibiting subsequent print production until a predetermined reset operation is carried out when the second total number of prints counted by said second cumulative print counting means reaches a second predetermined value which is larger than the first predetermined value.

* * * * *